United States Patent [19]

Turban et al.

[11] Patent Number: 4,490,824

[45] Date of Patent: Dec. 25, 1984

[54] COMPOSITE ELECTRODE FOR ARC FURNACE

[75] Inventors: Martin M. Turban, Lewiston; Lyman T. Moore, Niagara Falls; Mark D. Travers, Ransomville, all of N.Y.

[73] Assignee: Great Lakes Carbon Corporation, New York, N.Y.

[21] Appl. No.: 514,267

[22] Filed: Jul. 15, 1983

[51] Int. Cl.[3] ..... H05B 7/08

[52] U.S. Cl. ..... 373/93

[58] Field of Search ..... 373/82, 88, 91, 92, 373/93

[56] References Cited

U.S. PATENT DOCUMENTS 3,588,307 6/1971 Kegel et al. ..... 373/88

4,291,190 9/1981 Elsner et al. ..... 373/93

FOREIGN PATENT DOCUMENTS 77513 4/1983 European Pat. Off. ..... 373/93

*Primary Examiner*—Roy N. Envall, Jr.

*Attorney, Agent, or Firm*—Adrian J. Good

[57] ABSTRACT

A composite electric arc furnace electrode comprises a heavy-walled tubular graphite body with a sealed inner bore, a hollow nipple, a central coolant supply pipe, and a metal header assembly. If the unit fails, it is disassembled, a new graphite main tube assembled with the metal parts, and the graphite tube consumed in the normal fashion as a tip electrode.

9 Claims, 2 Drawing Figures

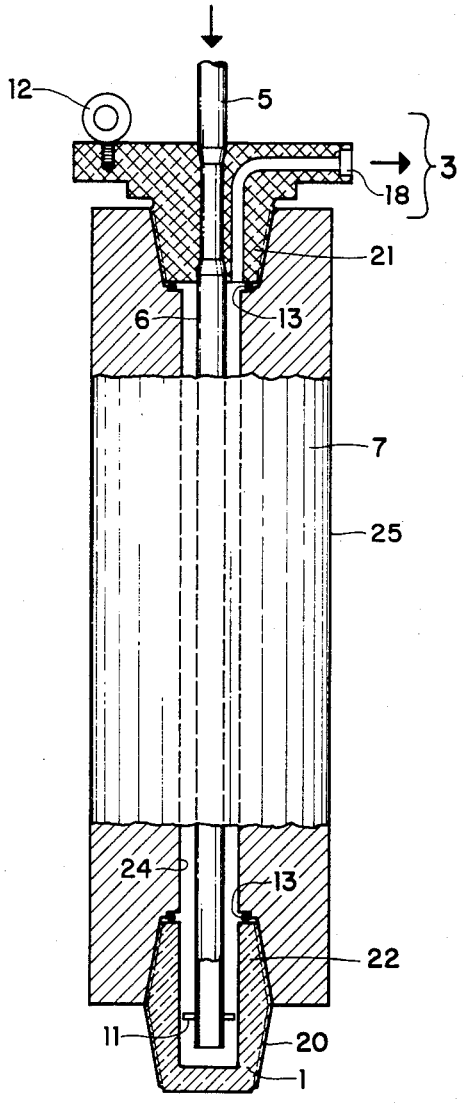
· Fig. 1 ·
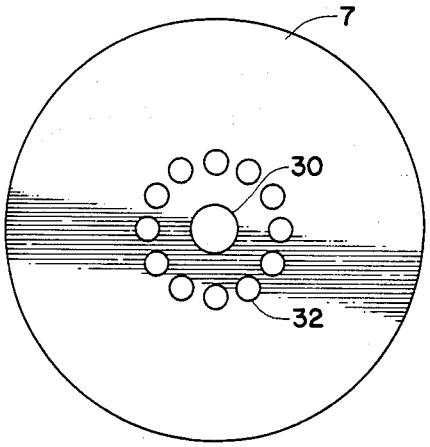
· Fig. 2 ·

COMPOSITE ELECTRODE FOR ARC FURNACE

BACKGROUND OF THE INVENTION

1. Field of the Invention

The Invention relates generally to an electrode for electric arc furnaces, and particularly to a composite electrode comprising a liquid-cooled long-lived but consumable upper portion attached to a conventional electrode (or consumable tip portion) joined to the upper portion by liquid-cooled connection means.

2. Description of the Prior Art

The conventional material employed in electrodes for electric arc furnaces is graphite. These electrodes are consumed in use, for example in electric arc steel making furnaces, due to erosion and corrosion caused by oxidation, sublimation, spalling and other factors. This consumption involves tip losses, column breakage losses and particularly surface oxidation losses. An average electric furnace consumes four to eight kilograms of graphite per metric ton of steel produced.

One method for reducing the consumption of graphite electrodes in arc furnaces has been the application of a protective coating or cladding material to the electrodes with oxidation resistant materials. These coatings generally increase the contact resistance to the electrode power clamp, and some are corrosive, as they are based on phosphoric acid. Consequently, they have not found wide acceptance.

Another means for reducing graphite electride consumption involves the utilizaiton of fully nonconsumable electrode systems. These systems employ full length liquid-cooled electrodes with selected apparatus to protect the electrode from the extreme temperatures of the arc. Although such systems appear in patent literature, this type has not been commercially successful.

It has been suggested heretofore that composite electrodes comprising carbon or graphite portions attached to a water-cooled metallic piece would provide means for reducing electrode consumption in arc furnaces. A number of patents have issued on specific composite electrode designs. For example, U.S. Pat. Nos. 986,429 to Becket; 2,471,531 to McIntyre et al.; 3,392,227 to Ostberg; 4,121,042 and 4,168,392 to Prenn; 4,189,617 and 4,256,918 to Schwabe et al.; and 4,287,381 to Montgomery relate to liquid cooled composite electrodes for arc furnaces. Likewise, European patent application Nos. 50,682; 50,583; and 53,200 by C. Conradty, Nurnburg are directed to composite electrode configurations.

OBJECTS OF THE INVENTION

It is the objective of the invention to provide an improved composite electrode for electric arc furnaces.

It is a further objective of the invention to provide a composite electrode wherein consumption of the graphite is substantially reduced.

It is a further objective of the invention to provide a composite electrode which is able to resist the harsh environment of an arc furnace and thereby have a long useful life.

It is a still further objective of the invention to provide a composite electrode which will be useful as a consumable electrode after failure as a permanent electrode.

SUMMARY OF THE INVENTION

The invention is essentially a composite water-cooled electrode comprising a graphite heavy-walled tubular body having a central bore, a water supply pipe within the bore, a hollow metal nipple located at the furnace end of the tubular body for attachment of a conventional graphite electrode, a metal header at the upper end of the tubular graphite body, and a liquid coolant supply system to cool said body.

The tubular graphite main structure body is made from a graphite arc furnace electrode with a threaded socket at each end. The central bore wall is preferably sealed to prevent water leakage and infiltration into or through the graphite wall. The exterior surface of the body may be treated with an anti-oxidant either by coating or impregnation; however, this is not always necessary. The electrode is normally drilled out with a center hole with a diameter not more than the minor diameter of the socket, leaving a heavy wall thickness preferably at least about ¼ of the outside diameter of the tube. The metal connecting nipple is hollow. A coolant supply pipe having an outside diameter (OD) smaller than the inside diameter (ID) of the electrode leads into the cavity from a header bringing coolant into the nipple through the center of the main tube. The coolant then returns upward to the outlet at the header through the annulus between the coolant inlet tube and the bore of the main structure. THe header is normally attached to the top of the graphite tube by the socket threads in the upper end of the main tube.

The coolant supply pipe may be omitted and the central bore used as the coolant inlet, with radially spaced passages used for coolant return.

The inner bore of the tube may be coated with a sealant to eliminate leakage and infiltration of water through the graphite. A two-package epoxy coating is preferred but other water-resistant surface coatings such as phenolic, alkyd, silicone, polyurethane, polyester or acrylic resins may also be used.

This electrode is highly resistant to the heat and agressive atmosphere of the electric arc furnace and the top portion of the attached consumable electrode in the furnace stays dark in use indicating efficient cooling to a temperature lower than the oxidation temperature, with consequent lessening of oxidation and lower graphite consumption per unit of metal produced, than when using the normal all-graphite solid electrodes.

This electrode also consumes less electricity than prior metal composite electrodes due to the absence of inductive heating losses or parasitic eddy currents which were noted to constitute a high drain on the arc current and to present a large heat loss to the cooling system.

It is a further advantage of the electrode of this invention that when the main structure deteriorates after long service, it may be disassembled, the metal parts used with a new graphite tube, and the failed piece consumed as an electrode in the normal manner.

DESCRIPTION OF THE DRAWINGS

FIG. 1 shows the complete composite electrode comprising a graphite tubular body structure 7 having threaded upper socket 21 and lower socket 22, and a hollow nipple 1, which may be copper, steel, cast iron, ductile iron, Invar, or other material of high strength, electrical conductivity, and heat conductivity, with threads 20, for attachment of the graphite electrode to the body 7. Header assembly 3 at the top of body 7 is metal, aluminum as shown here, but may be any other material with the required strength such as cast iron, ductile iron, steel, or copper. A metal coolant inlet pipe extension 5 serves as a cooling water inlet, carrying coolant through header 3 to coolant inlet pipe 6 in the bore of main tube body 7 into the hollow nipple 1 and back through the annulus between metal tube 6 and inside bore wall of the grpahite main structure 7 to header 3 and outlet tube 18. O-rings 13 seal the structure against leakage. The inner bore of main structure 7 is sealed with a surface coating 24, preferably an epoxy coating but which may be any of a wide variety of coatings including alkyds, phenolics, acrylics, silicones, polyester, polyurethane, or other water-resistant surface coatings. The exterior of tube 7 may be coated or impregnated with a heat and oxidation-resistant coating 25. Eyebolt 12 facilitates handling of the electrode. Spacers 11 keep tube 6 concentric within the tube 7 and nipple 1, and electrically isolated from the nipple.

FIG. 2 depicts a modification of the imvention without a central coolant inlet pipe, the cross-sectional view showing inner bore 30 serving as coolant inlet and radially spaced passages 32 serving a coolant returns, giving the advantage of better cooling efficiency at the outer diameter of tube 7.

The electrode is preferably made of graphite having a coefficient of thermal expansion (CTE) of no more than $15\times10^{-7}$ (cm/cm/°C. tested over the range of 0°–50° C.). If graphite with high CTE is used, the electrode may fail from thermal shock.

When using a biconical nipple as shown in the drawings, the inner bore of tube 7 may be as large as the minor diameter of the nipple, or of the same diameter as the socket base. In general, a wall thickness of at least ¼ the outer diameter of the graphite main tube 7 should be observed.

DETAILED DESCRIPTION OF THE INVENTION

Electrodes were made by boring a 10 cm (4 in.) hole through the center of 41 cm (16 in.) graphite electrodes with standard threaded sockets at each end. The inner walls of the tubes thus formed were sealed by coating with a two-component epoxy coating. Some of the electrodes were coated on the exterior with an anti-oxidant coating according to co-pending Ser. No. 442,651 filed Nov. 18, 1982 by Wilson. The header and water supply pipes were attached at the upper ends and copper nipples at the lower ends. The units were furnished with 36 cm (14 in.) electrodes. placed in the electrode power clamps of an electric arc furnace, and the cooling water connected to the water supply pipes. The electrodes were used for melting scrap, making steel for concrete reinforcing bar and rod stock. A total of 101 heats was run in this trial with a graphite consumption of 8 lbs/T (4 kg/mT) as against a normal usage of 10.8 lbs/T with solid electrodes, with very few operating problems. There was no side arcing which is an undesirable phenomenon described as an arc from the furnace metal charge to the side of the electrode instead of at the tip. Eddy current heat loss was very low as compared to a steel tubular composite electrode. When a unit failed in service, it was disassembled, the main structure replaced, reusing the metal components, and the failed graphite piece used as a tip electrode.

We claim:

1. A liquid cooled electrode for use on an electric arc furnace comprising:
   a. a main structure consisting of a graphite tube having threaded sockets at each end;
   b. a metal header at one end having a coolant supply inlet and outlet;
   c. a hollow metal nipple at the other end;
   d. a coolant supply pipe from said header traversing the bore of said tube into the interior of said nipple, the outside diameter of said pipe being substantially less than the inside diameter of said tube;
   e. said tube being usable as a tip electrode after normal life as a composite electrode by disassembly and removal of said header, pipe and nipple and reattachment to a nipple.

2. The electrode of claim 1 wherein the inner bore of said tube is sealed with a resinous coolant-resistant coating.

3. The electrode of claim 1 wherein the coolant enters through inlet means in the header, passes through a coolant supply pipe into the interior of the nipple and returns through the annulus between the supply pipe and the interior of the graphite tube to the header and exits through an outlet in said header.

4. The electrode of claim 1 wherein the header, the coolant supply pipe and the nipple are each selected from the group of metals consisting of copper, aluminum, steel, Invar, ductile iron, and cast iron and where each of said parts may be of a different one of said group.

5. The electrode of claim 1 wherein the coolant supply pipe is maintained concentric within either one or both of the graphite tube or the nipple by spacing means.

6. The electrode of claim 1 wherein the wall thickness of the graphite tube is at least ¼ the outside diameter of said tube.

7. The electrode of claim 1 consisting of grahite with a CET of no more than $15\times10^{-7}$ cm/cm/°C. over the range of 0° to 50° C.

8. The electrode of claim 1 wherein the inner bore is not larger than the minor diameter of the socket at the bottom of said socket.

9. A liquid cooled electrode for use on an electric arc furnace comprising:
   a. main structure consisting of a graphite tube with an upper and a lower end with threaded sockets;
   b. said tube having a wall thickness of a least ¼ the outside diameter of said tube;
   c. said tube being sealed on its interior by an applied coolant-resistant coating;
   d. said electrode being cooled by means of a water inlet pipe concentric with said tube;
   e. said water being exhausted through the annulus between said inlet pipe and the inside wall of said tube;
   f. said tube having a hollow metal threaded nipple selected from the group of metals consisting of copper, steel, Invar, cast iron and ductile iron, said nipple being attached to the lower end of said tube;
   g. said inlet pipe extending into and terminating in the interior of said nipple, whereby said nipple is water cooled;
   h. said inlet being maintained concentric with said tube and nipple by spacing means;
   i. said tube having at its upper end a header wth inlet and outlet passage means for said water.

* * * * *

UNITED STATES PATENT AND TRADEMARK OFFICE

CERTIFICATE OF CORRECTION

PATENT NO. : 4,490,824

DATED : December 25, 1984

INVENTOR(S) : Martin M. Turban, et al

It is certified that error appears in the above-identified patent and that said Letters Patent is hereby corrected as shown below:

In column 1, line 32, "electride" should be "electrode".

In column 3, line 24, "a coolant" should be "as coolant".

In column 4, line 39, "CET" should be "CTE".

Signed and Sealed this

*Second* Day of *July 1985*

[SEAL]

*Attest:*

DONALD J. QUIGG

*Attesting Officer* *Acting Commissioner of Patents and Trademarks*